US009130327B2

(12) United States Patent
Flynn et al.

(10) Patent No.: US 9,130,327 B2
(45) Date of Patent: Sep. 8, 2015

(54) POWER ASSEMBLY FOR DISPLAY

(71) Applicants: Michael Flynn, Paramus, NJ (US); George Cox, Hamburg, PA (US); Saket Gohil, Phoenixville, PA (US)

(72) Inventors: Michael Flynn, Paramus, NJ (US); George Cox, Hamburg, PA (US); Saket Gohil, Phoenixville, PA (US)

(73) Assignee: TRINITY, LLC, Metuchen, NJ (US)

( * ) Notice: Subject to any disclaimer, the term of this patent is extended or adjusted under 35 U.S.C. 154(b) by 0 days.

(21) Appl. No.: 14/307,194

(22) Filed: Jun. 17, 2014

(65) Prior Publication Data

US 2014/0370730 A1 Dec. 18, 2014

Related U.S. Application Data

(60) Provisional application No. 61/836,550, filed on Jun. 18, 2013.

(51) Int. Cl.

*H01R 25/00* (2006.01)
*H01R 25/14* (2006.01)
*H01R 13/64* (2006.01)

(52) U.S. Cl.

CPC ..... *H01R 25/147* (2013.01); *H01R 13/64* (2013.01); *H01R 25/14* (2013.01); *A47B 2220/0075* (2013.01)

(58) Field of Classification Search

CPC .... H01R 13/703; H01R 13/64; H01R 13/642; H01R 25/161; H01R 25/14; H01R 25/142; H01R 25/147

USPC ..... 439/122, 110–121, 680, 681, 677, 265

See application file for complete search history.

(56) References Cited

U.S. PATENT DOCUMENTS

| | | | | | |
|---|---|---|---|---|---|
| 1,786,598 | A | * | 12/1930 | Broer | 439/265 |
| 2,636,950 | A | | 4/1953 | Boadway | |
| 2,850,711 | A | * | 9/1958 | Terlinde | 439/269.2 |
| 3,013,242 | A | * | 12/1961 | Terlinde | 439/269.2 |
| 3,089,042 | A | | 5/1963 | Hickey | |
| 3,150,907 | A | * | 9/1964 | Petroske | 439/121 |
| 3,246,074 | A | | 4/1966 | Manfred | |
| 3,529,274 | A | | 9/1970 | Routh | |
| 3,546,367 | A | | 12/1970 | Hart | |
| 3,551,617 | A | | 12/1970 | Seelbach | |
| 3,553,398 | A | | 1/1971 | Seelbach | |
| 3,588,786 | A | * | 6/1971 | Alfiero | 439/265 |
| 3,757,063 | A | | 9/1973 | Hart | |
| 3,757,273 | A | * | 9/1973 | Hesse | 439/117 |
| 3,792,413 | A | * | 2/1974 | Hyrlainen | 439/117 |
| 3,801,851 | A | | 4/1974 | Andoh et al. | |
| 3,825,879 | A | * | 7/1974 | Hesse | 439/117 |
| 3,871,730 | A | * | 3/1975 | Hesse | 439/115 |
| 4,003,618 | A | | 1/1977 | Booty | |
| 4,032,208 | A | * | 6/1977 | Berkenhoff | 439/122 |
| 4,256,357 | A | * | 3/1981 | Vasseur et al. | 439/115 |
| 4,699,439 | A | * | 10/1987 | Cohen | 439/207 |
| 4,861,273 | A | * | 8/1989 | Wenman et al. | 439/111 |
| 4,949,487 | A | * | 8/1990 | Kibarer | 40/551 |
| 4,999,755 | A | | 3/1991 | Lin | |

(Continued)

*Primary Examiner* — Neil Abrams
*Assistant Examiner* — Travis Chambers
(74) *Attorney, Agent, or Firm* — Cozen O'Connor

(57) ABSTRACT

A clip connector is configured to cooperate with a power strip for providing power to an LED display such that the clip connector is insertable into the power strip by a user compressing the first and second legs towards one another and first inserting the first leg into the first channel of the power strip and then inserting the second leg into the second channel of the power strip.

20 Claims, 7 Drawing Sheets

(56) References Cited

U.S. PATENT DOCUMENTS

| | | | | |
|---|---|---|---|---|
| 5,003,443 | A | 3/1991 | Sabala | |
| 5,096,429 | A * | 3/1992 | Fraser | 439/115 |
| 5,341,276 | A | 8/1994 | Shen | |
| 5,348,485 | A | 9/1994 | Briechle | |
| 5,599,086 | A * | 2/1997 | Dutta | 362/490 |
| 6,059,582 | A | 5/2000 | Tsai | |
| 6,170,967 | B1 | 1/2001 | Usher | |
| 7,077,669 | B1 | 7/2006 | Walters | |
| 7,491,079 | B2 * | 2/2009 | Uchida | 439/265 |
| 7,722,230 | B2 | 5/2010 | Chien | |
| 7,758,358 | B1 * | 7/2010 | Mier-Langner et al. | 439/115 |
| 8,469,728 | B1 | 6/2013 | Luksic | |
| 2013/0299439 | A1 | 11/2013 | Sid | |

* cited by examiner

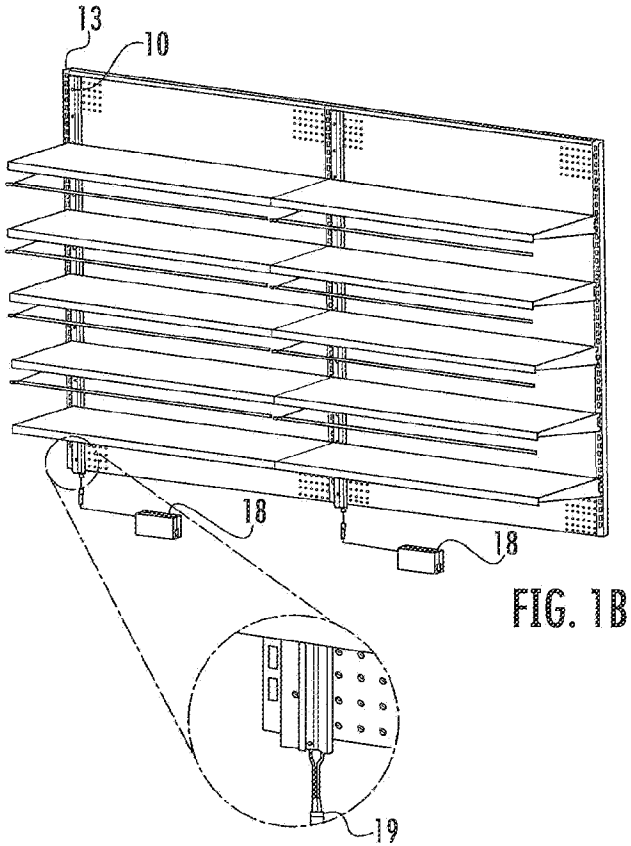
FIG. 1B
FIG. 1C
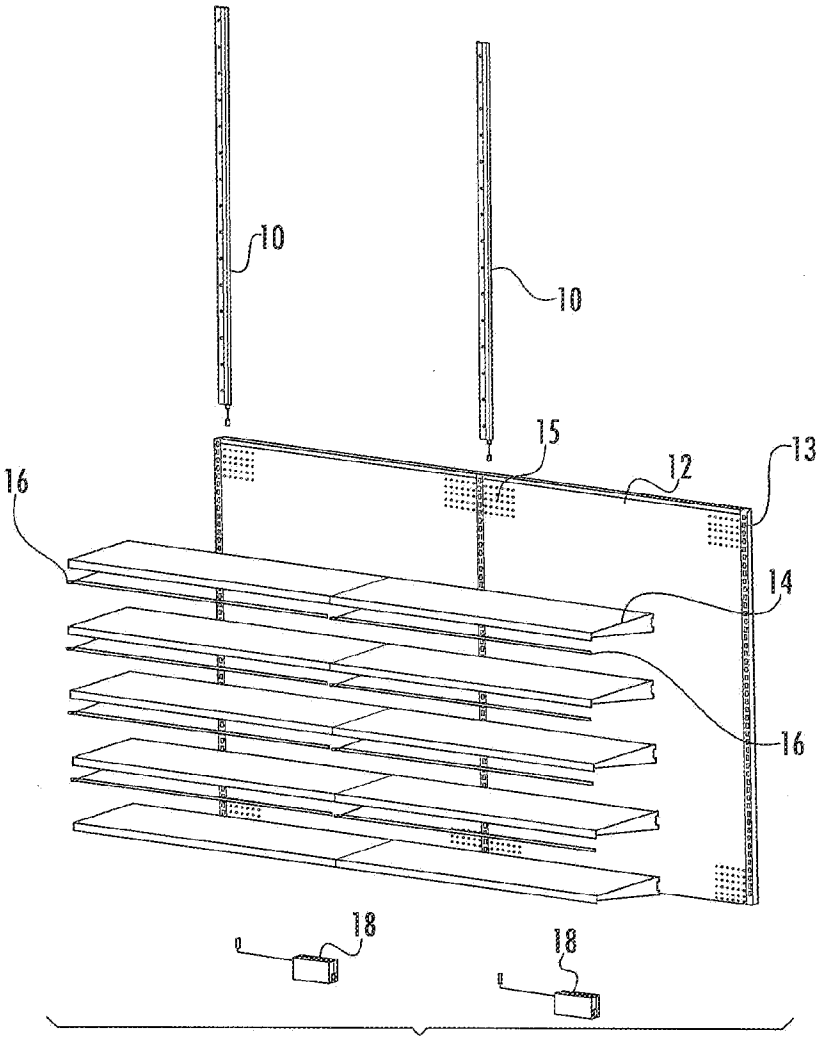
FIG. 1A

POWER ASSEMBLY FOR DISPLAY

CROSS-REFERENCE TO RELATED APPLICATION

This application claims the benefit of U.S. Provisional Patent Application No. 61/836,550, filed on Jun. 18, 2013, entitled "VERTICAL RETROFIT DC POWER STRIP", which is hereby incorporated by reference in its entirety.

FIELD OF THE INVENTION

The disclosed embodiments relate to the field of power strips and associated connectors that allow DC power to be transferred from a power supply directly into a low voltage power strip, at the back of a shelf or gondola, that the lighting unit plugs into without the need for an additional wire harness. This system allows for LED units used in product displays and point of purchase displays to easily connect to any point on the power strip regardless of LED height location.

BACKGROUND OF THE INVENTION

In typical illuminated product displays, a vertical power strip with multiple equidistantly-spaced apart outlets is provided to supply power to the lights/LEDs used at each shelf height in the vertical array to illuminate product positioned on the display. The LEDs and associated wiring for product placed on each shelf are located on the underside of the adjacent shelf positioned above a subject shelf. The wiring is then grouped and positioned at a back corner of the shelf and extended down along the vertical power strip to an available outlet/plug on the strip. This arrangement not only results in an unsightly bundle of electrical wires, but makes it more difficult to disassemble or otherwise reconfigure the shelf display and/or relocate specific lights because of the wires. Moreover, the wires must be of sufficient length to connect to the next available outlet on the vertical outlet strip.

U.S. Pat. No. 7,077,669 teaches a snap-in connector for aircraft weapons testing, but is not directed to lighting. This patent includes electrical connections of the type using a continuous outlet with a conducting clip. The figure on the cover page of the patent shows a clip having legs which seat in a conducting channel. The legs are inserted into the channel by compressing the legs together and then releasing them. However, because the legs are of the same size, there is an increased likelihood that the clip could be inserted upside down.

U.S. Pat. No. 5,348,485 shows a product display system with lighting. The display uses a continuous vertical power strip to which snap-on connectors are attached. The connectors have legs which engage outer edges of the strip.

U.S. Pat. No. 5,003,443 is a lighting display structure having a continuous power strip. Lighting elements are connected to the power strip, but do not connect with compression-type clips. Moreover, the lighting elements are only capable of being connected at certain locations.

U.S. Pat. No. 4,999,755 discloses a tube light in which lights are mounted to a continuous track. The light sockets are configured as blocks and are connected by sliding at an end of the track and then rotated 90 degrees into position such that the block conductors engage the track conductors.

U.S. Pat. No. 4,032,208 discloses a connector for track lighting. In this patent, each light base is inserted into the track and then twisted to provide engagement. A release clip 62 is also provided which must be engaged to release the light from the track.

U.S. Pat. No. 3,801,951 provides another track lighting system. The patent discloses arms that are compressed together to insert a light housing into a conductor channel. Once released, the arms move back into place.

SUMMARY OF THE INVENTION

It is an object of the invention to provide LED light units that securely connect via a spring connector to a DC power strip to provide a secure, error-free, connection to the provide power to the LEDs. To achieve this object, the LED light units are coupled to a spring connector, the edges of which contact conducting strips in the DC power strip. In advantageous embodiments, the spring connector is configured to ensure proper orientation of the LED unit's associated spring connector in relation to the DC power strip, as well as to ensure a secure connection between the spring connector and the DC power strip.

In accordance with a first aspect of the present invention, a power supply system for supplying electrical power to an LED light display module for lighting at least a portion of a fixture includes: a power strip connectable to a power supply and configured to be affixable with respect to the fixture, the power strip having: first and second ridges configured to form, respectively, a first channel along a length of the power strip and a second channel, narrower than the first channel, along the length of the power strip, first and second conductor strips arranged, respectively, in the first and second channels, and a connector at one end of the power strip, configured to electrically couple the first and second conductor strips to the power supply; and a clip connector for supplying power to the LED light display module, the clip connector being configured to detachably connect to the power strip, the clip connector having: a housing, first and second legs extending from the housing, the first leg being wider than the second leg, the first and second legs being configured with respect to the housing so as to be (a) deflectable in relation to the housing and one another by application of an outside force, and (b) biased to resiliently maintain a spacing between the first and second legs without external application of force, and first and second conductive leads arranged on the first and second legs to form first and second conductive contacts on the first and second legs, the first and second conductive contacts being configured to contact, respectively, the first and second conductor strips of the power strip, after insertion of the first and second legs into the first and second channels. The clip connector and the power strip are configured to cooperate such that the clip connector is insertable into the power strip by a user compressing the first and second legs towards one another and first inserting the first leg into the first channel of the power strip and then inserting the second leg into the second channel of the power strip.

In another aspect, once the clip connector is inserted into the power strip, the clip connector is movable in a lengthwise direction of the power strip while the first and second legs remain within their respective channels by compressing the first and second legs towards one another.

In another aspect, the fixture comprises a shelving system including shelves and a backing board, and the power strip is configured to mount to the backing board.

In another aspect, the power strip is configured to mount to the backing board by pegboard pushpins.

In another aspect, the LED light display module is arranged below a shelf.

In another aspect, the first and second conductor strips terminate at one end of the power strip with a barrel connector that electrically couples to the power supply.

In another aspect, the clip connector further comprises a plunger movable in the housing between a first, retracted position and a second, engaged position, said plunger configured to, in the engaged position, deflect the first and second legs apart from one another.

In another aspect, deflection of the first and second legs effected by the plunger in the engaged position: (a) provides a secure electrical connection between first and second conductive contacts and the first and second conductor strips of the power strip, and (b) inhibits movement of the clip connector along the length of the power strip.

In another aspect, the housing and the first and second legs of the clip connector are made of an extruded plastic.

In another aspect, the first and second conductor strips are arranged in the power strip so as not to be visible to an outside observer.

In another aspect, the housing of the clip connector comprises indicia to indicate a correct orientation for engaging the clip connector in the channels of the power strip.

In another aspect, the first and second conductor strips and the first and second conductive leads are made of copper.

In another aspect, the first and second conductor strips and the first and second conductive leads are made of aluminum.

In another aspect, the barrel connector attaches to the conductor strips using ring terminals.

In accordance with another aspect of the present invention, a clip connector electrically coupled to the LED light display module, the clip connector for detachably connecting to a power strip having first and second channels and first and second conductor strips electrically coupled to a power supply, includes: a housing; first and second legs extending from the housing, the first leg being wider than the second leg, the first and second legs being configured with respect to the housing so as to be (a) deflectable in relation to the housing and one another by application of an outside force, and (b) biased to resiliently maintain a spacing between the first and second legs without external application of force; and first and second conductive leads arranged on the first and second legs to form first and second conductive contacts on the first and second legs, the first and second conductive contacts being configured to contact, respectively, the first and second conductor strips of the power strip, after insertion of the first and second legs into the first and second channels. The clip connector is configured to cooperate with the power strip such that the clip connector is insertable into the power strip by a user compressing the first and second legs towards one another and first inserting the first leg into the first channel of the power strip and then inserting the second leg into the second channel of the power strip.

In another aspect, once the clip connector is inserted into the power strip, the clip connector is movable in a lengthwise direction of the power strip while the first and second legs remain within their respective channels by compressing the first and second legs towards one another.

In another aspect, the clip connector further includes a plunger movable in the housing between a first, retracted position and a second, engaged position, the plunger configured to, in the engaged position, deflect the first and second legs apart from one another.

In another aspect, deflection of the first and second legs effected by the plunger in the engaged position: (a) provides a secure electrical connection between first and second conductive contacts and the first and second conductor strips of the power strip, and (b) inhibits movement of the clip connector along the length of the power strip.

In another aspect, the housing and the first and second legs of the clip connector are made of an extruded plastic.

In another aspect, the housing of the clip connector comprises indicia to indicate a correct orientation for engaging the clip connector in the channels of the power strip.

BRIEF DESCRIPTION OF THE DRAWINGS

The above and/or other aspects and advantages will become more apparent and more readily appreciated from the following detailed description of the disclosed embodiments taken in conjunction with the accompanying drawings in which:

FIGS. 1A and 1B are exploded and perspective views, respectively, illustrating an exemplary environment in which a vertical power strip and clip connector in accordance with an embodiment of the present invention operate;

FIG. 1C is a magnified view of a portion of FIG. 1B showing a detail of the termination of the conductor strips at one end of the strip connector;

DETAILED DESCRIPTION OF THE PRESENTLY PREFERRED EMBODIMENTS

Figure 2B:
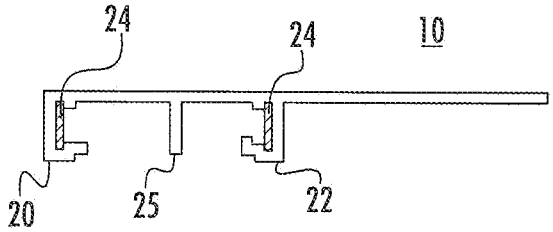
FIGS. 2A and 2B are perspective and side views, respectively, of a vertical power strip in accordance with an embodiment of the present invention.

In the following description, like elements will be referred to using like reference numerals.

With reference to FIGS. 1A to 1C, the disclosed exemplary embodiments relate the use of inventive vertical power strips 10 that can be affixed to shelving back boards 12, having, at each edge, railings 13 for provision and installation of shelves 14, for example, gondola shelves 14. LED lighting modules 16, which receive electrical power from the vertical power strips 10, are arranged in relation to the shelves 14 to illuminate items that may be on the shelves 14, such as in a retail environment.

As will be developed in greater detail below, the LED lighting modules 16 receive power via associated connector clips that are configured to electrically couple with the vertical power strips 10. The back boards 12 to which the shelves 14 are affixed, at the railings 13, have peg holes 15 that are configured to allow attachment of the vertical power strips 10.

As can be seen in FIGS. 1A and 1B, to provide for the lighting of the shelves 14, for example in a retail setting, slim LED pencil light modules 16 are arranged under each shelf 14. To supply power to the light modules 16, a connection is provided between a power supply 18, typically located under the lowest shelf 14, and DC connectors of the LED light modules 16.

In accordance with the present invention, the electrical connection is provided by supplying electrical power from the power supply 18 to conductor strips 24 in the vertical power strips 10. As can be seen in the magnified view of FIG. 1C, the conductor strips 24 terminate at one end of the vertical power strip 10 with a barrel connector 19. This barrel connector allows for the unit to remain modular, and not be permanently connected to the power supply 18. The barrel connector preferably attaches to the conductor strips 24 using ring terminals.

Spring clip connectors, to be discussed below in relation to further figures, are attachable to the vertical power strips 10 and are configured to electrically couple, in an adjustable yet secure manner, the LED light modules 16 with the conductor strips 24 of the vertical power strips 10.

Figure 2A:
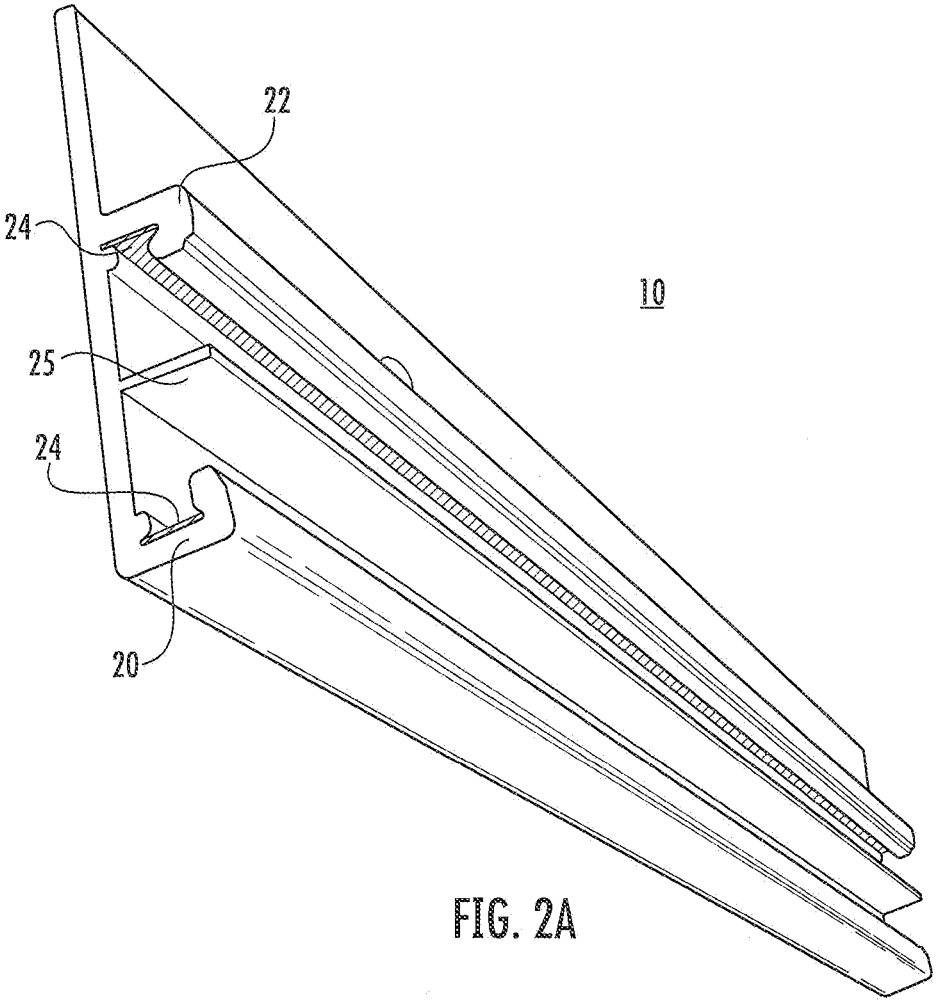

As shown in FIGS. 2A and 2B, the vertical power strip 10 includes channel-forming flanges 20 and 22. Each flange is configured to form a U-shaped channel in which a conductor strip 24 is installed. In a preferred embodiment, the conductor strips 24 run substantially the entire length of the vertical power strip 10 and are arranged to face inwardly, in particular facing each other, so that they are hidden from the sight of the shopper when the vertical power strip 10 is viewed from the front, making the vertical power strip 10 more aesthetically appealing to the retailer and the shopper.

The conductor strips 24 are made of a conductive material, such as, but not limited to, for example copper or aluminum. The vertical power strip 10 also has a ridge 25, running along the vertical power strip's front facing surface in the lengthwise direction, but arranged off-center so as to define, in relation to the channel-forming flanges 20 and 22, a wider channel and a narrower channel.

The vertical power strip 10 is configured to cooperate with the power supply 18 such that each conductor strip 24 carries power of a particular electrical polarity (i.e., positive or negative). To achieve this, the bottom of the vertical power strip 10 is configured to electrically couple the conductor strips 24 to the power supply 18, as discussed above with regard to FIGS. 1A to 1C. Other than the conductor strips, the vertical power strip 10 is preferably made of a non-conducting material, such as extruded plastic.

The conductor power strip 10 is preferably mounted using standard peg board push pins, which allows for the unit to remain modular, should planograms change. However, mounting can also be achieved using screw hardware, industrial strength tape, or custom brackets, for example.

To conduct the electrical power from the conductor strips 24 to the LED light module 16, a spring clip connector 26 is provided. In a first embodiment, the spring clip connector 26 electrically couples with the channels formed by flanges 20 and 22 and the ridge 25.

As can be seen in FIGS. 3A to 3I, the spring clip connector 26 according to a first embodiment has a housing 30, a deflectably resilient wide leg 32, and a deflectably resilient narrow leg 34. The housing and the legs are preferably made of plastic. The wide and narrow legs 32 and 34, respectively, are each generally L-shaped, with protrusions extending outwardly in opposite directions. The legs 32 and 34 are maintained at a distance A from one another by a retaining U-shaped spring 36 arranged in the housing 30 between the legs 32 and 34, as well as by the resilience of the legs themselves.

The combination of the resilience of the legs and the U-shaped spring 36 biases the legs 32 and 34 so as to maintain the distance A therebetween in the absence of application of an outside force. However, because the legs 32 and 34, and the U-shaped spring 36 are resilient, a user can provide a squeezing force to the outer portion of the legs 32 and 34 to decrease the space between the legs. As will be discussed in more detail below, such squeezing is utilized when connecting the spring clip connector 26 to the vertical power strip 10.

Figure 3A:
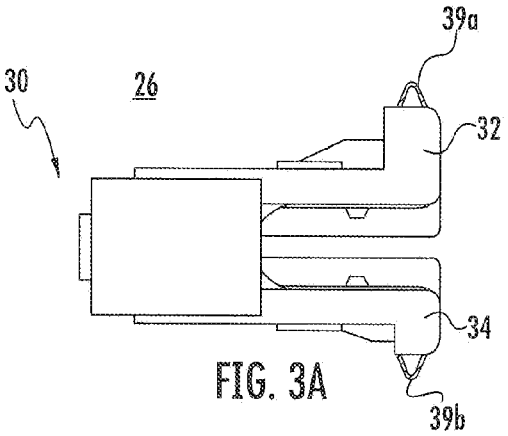
FIG. 3A is a top view of a clip connector according to an embodiment of the present invention.
Figure 3B:
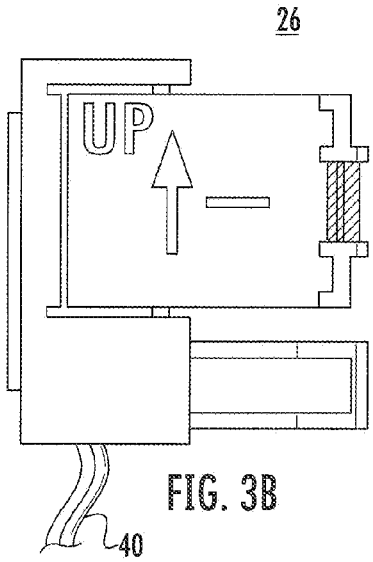
FIG. 3B is a right elevation view of the clip connector shown in FIG. 3A.
Figure 3C:
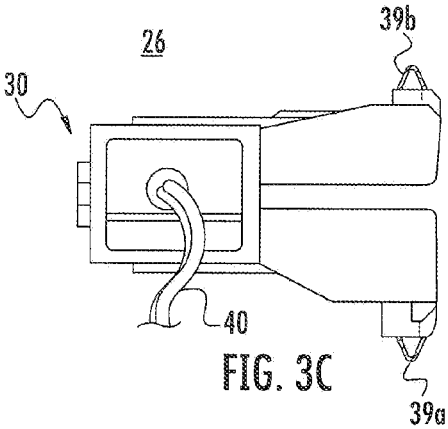
FIG. 3C is a bottom view of the clip connector shown in FIG. 3A.
Figure 3D:
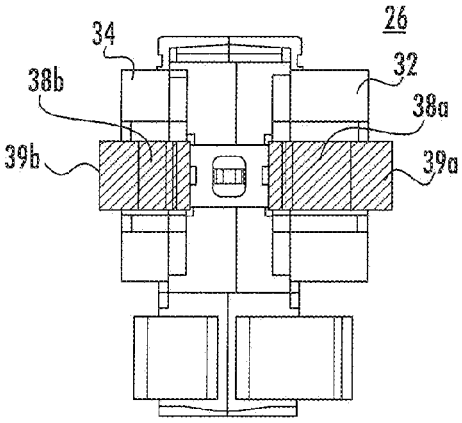
FIG. 3D is a front elevation view of the clip connector shown in FIG. 3A.
Figure 3E:
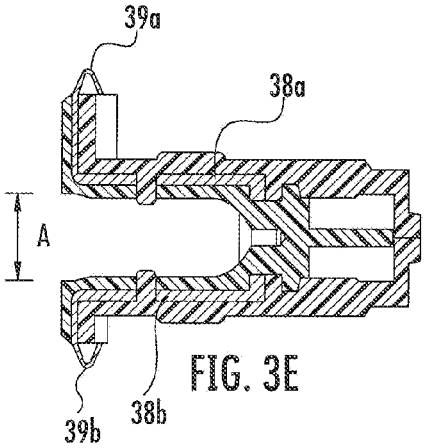
FIG. 3E is a sectional view of the clip connector shown in FIG. 3A.
Figure 3F:
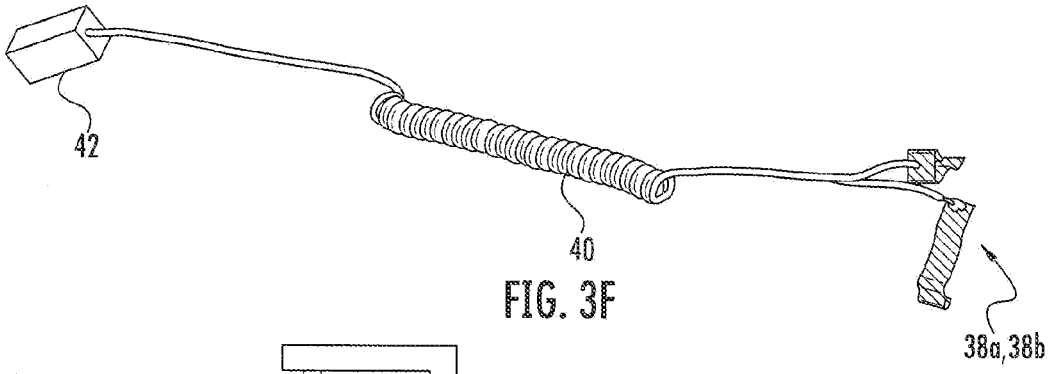
FIG. 3F is a view showing wires used in the clip connector connected to leads and connected to an LED connector, in accordance with an embodiment of the present invention.
Figure 3G:
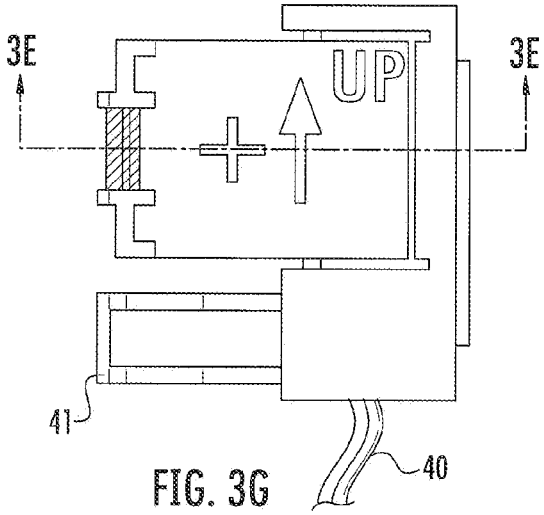
FIG. 3G is a left side elevation view of the clip connector shown in FIG. 3A.
Figure 3H:
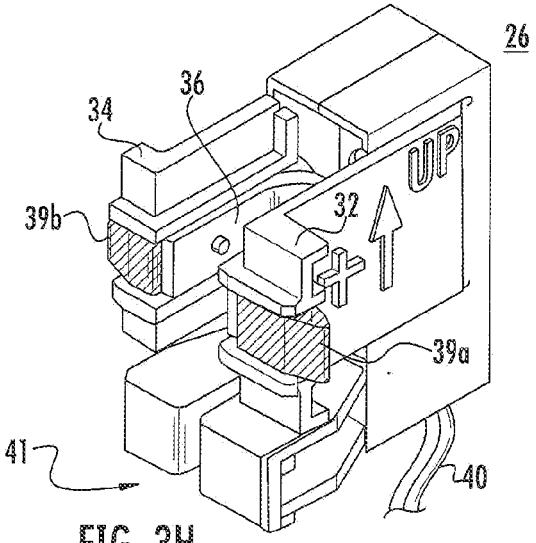
FIG. 3H is a left side perspective view of the clip connector shown in FIG. 3A.
Figure 3I:
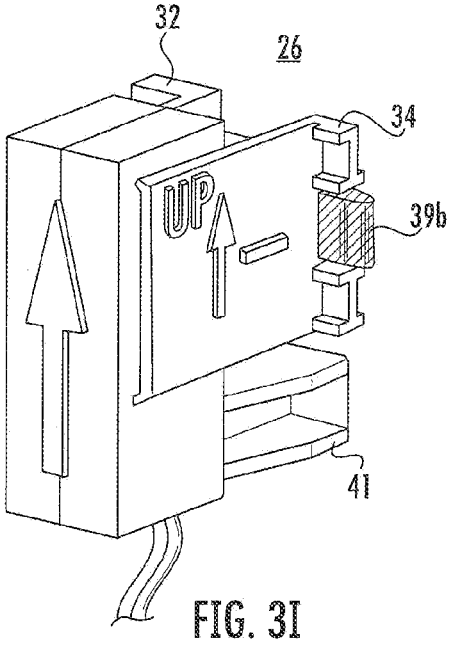
FIG. 3I is a right side perspective view of the clip connector shown in FIG. 3A.

As can be seen in the sectional view of FIG. 3E, two conductive leads 38*a* and 38*b* are arranged within the housing 30. Wires 40, connected to the leads 38*a* and 38*b*, shown separately in FIG. 3F, extend out of the bottom of the housing 30. As shown in FIG. 3F, in a disclosed embodiment, the wires 40 terminate in an LED connector 42, which provides a connection with LED light modules 16. A bottom portion 41 of the housing provides a groove that mates with the ridge 25.

The conductive leads 38*a* and 38*b* are arranged within the housing to hug the surface between the U-shaped spring 36 and the inner surfaces of the legs 32 and 34, and to bend around the legs 32 and 34 so as to form extending conductive tips 39*a* and 39*b*, respectively, at the outer ends of corresponding legs. The conductive leads 38*a* and 38*b* are made of a conductive material, such as, but not limited to, for example copper or aluminum.

The combination of the leads 38*a* and 38*b*, with corresponding conductive tips 39*a* and 39*b*, and the wires 40 serve to, when the spring clip connector 26 is fully engaged within the U-shaped channels in the vertical power strip 10, provide a connection between the power supply 18 and the LED light module 16. In particular, once the legs of the spring clip connector 26 are engaged in the channels of the vertical power strip, an electrical connection is established between the conductive tips 39*a* and 39*b* and the conductor strips 24, which connection provides power from the power supply 18 to the LED light modules 16, via the connector at the end of the wires 40.

The vertical power strip 10 and the spring clip connector 26, aside from the conductor strips 24, the conductive leads 38*a* and 38*b*, with corresponding conductive tips 39*a* and 39*b*, and the wires 40, are preferably fabricated from non-conductive material, such as extruded plastic.

The LED light modules 16, in the exemplary embodiment, operate on DC power. As a result, it is important that the leads 38*a* and 38*b* of the spring clip connector each engage the conductor strip 24 having the corresponding polarity so that the positive line from the power supply 18 is ultimately supplied to the positive input of the LED light module 16, and the negative line from the power supply 18 is ultimately supplied to the negative input of the LED light module 16.

To ensure application of the correct polarity, the spring clip connector 26 is configured so that it may engage the vertical power strip 10 in only the correct orientation to make the electrical connection discussed above. That is, by virtue of the configuration of the spring clip connector 26, it can only be mated with or connected to the vertical power strip 10 in the direction of the correct polarity.

Figure 4:
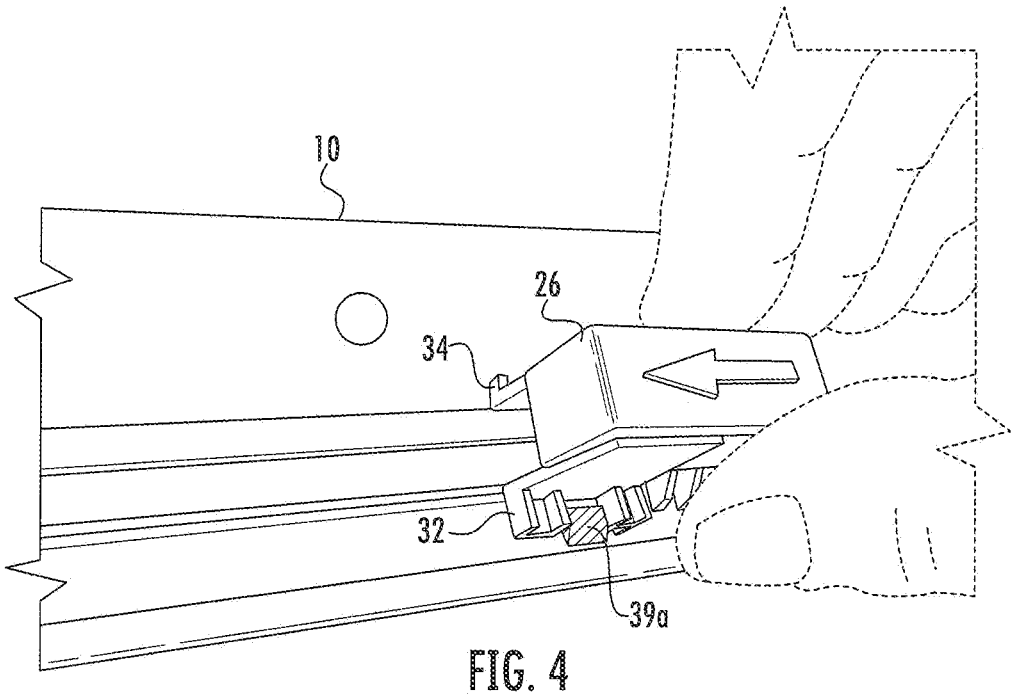
FIG. 4 is a perspective view showing the clip connector being installed in the vertical power strip, according to one embodiment of the present invention.
Figure 5:
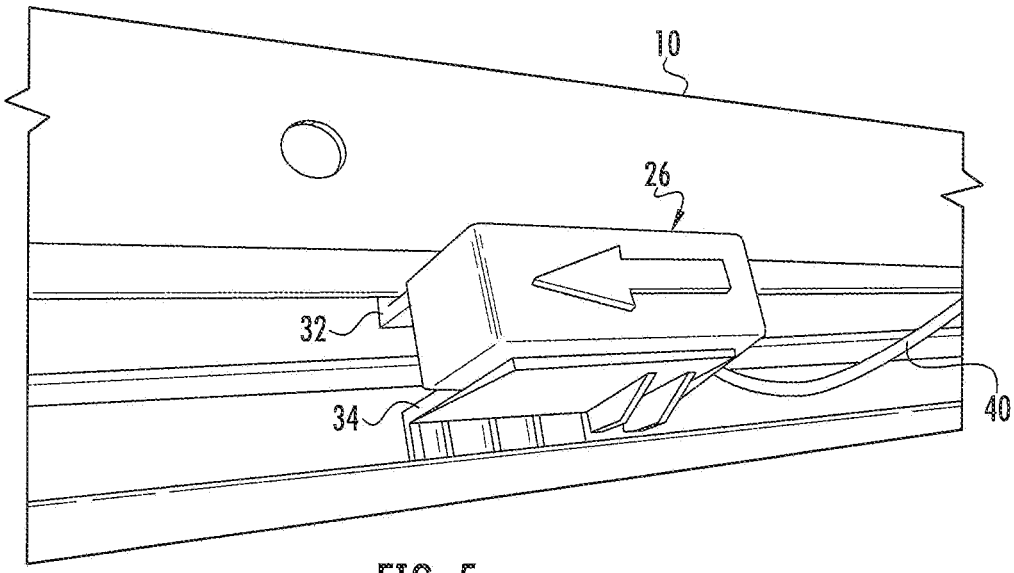
FIG. 5 is a perspective view showing the clip connector that has been installed in the vertical power strip, according to one embodiment of the present invention.
Figure 6:
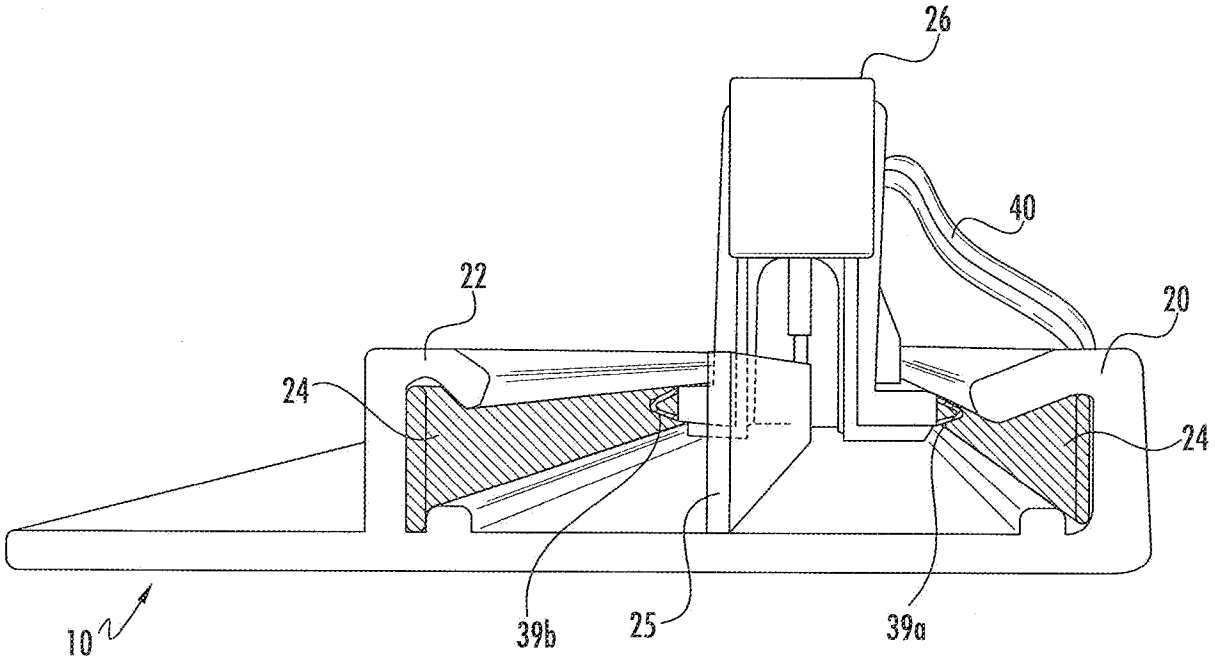
FIG. 6 is a front view showing the clip connector that has been installed in the vertical power strip, according to one embodiment of the present invention.

In particular, due to the asymmetrical disposition of the ridge 25, two channels of different widths are formed in the vertical power strip. As a result, the spring clip connector 26, when squeezed, can only be inserted with the wide leg 32 first, followed by the narrow leg 34. Moreover, only the wide leg 32 can be inserted in the wide channel, ensuring the correction polarity of connection. Insertion of the spring clip connector is shown in FIGS. 4 to 6.

To further ensure that the correct polarity is established by the connection, preferably the housing of the spring clip connector 26 has markings to indicate the polarity of each leg as well as an arrow to indicate the correct upward orientation. orientation to engage the spring clip connector 26 in the channels of the vertical power strip 10.

Once the spring clip connector 26 is positioned in place, an electrical connection is formed and the spring clip connector 26 can be moved vertically, up or down, to facilitate adjustment of the placement of the LED lighting modules 16 at any required height with respect to the shelves 14. Thus, the present invention allows for LED light units, e.g., in a store, to connect to any point on the vertical power strip 10 regardless of LED height location. This advantageous feature allows store associates and/or installation groups to install LED light fixtures easily and/or change shelf layouts with ease, and without concern of wire management.

That is, once the spring clip connector 26 is engaged with the vertical power strip 10, it will make connection with the conductor strips 24 and provide power to the LED lighting modules 16. If a new position is required on the vertical power strip 10, the clip connector 26 does not need to be removed. By compressing the sides of the clip connector 26, the user can reduce the contact between the clip connector 26 and the conductor strips 24. Then a new position can be reached by sliding the clip connector 26 within the channels of the vertical power strip 10 up or down, as opposed to removing the clip from the channel and replacing it higher or lower in the vertical power strip 10. This makes installation adjustments and planogram changes easy.

The above-described system works as a conduit to transfer the low voltage power from the power supply to the LED lighting modules. As such, it can be used with any number of constant voltage LED lighting modules.

In a second embodiment, a modified clip connector 260 performs the connection function of the clip connector 26 in relation to the vertical power strip 10. The modified clip connector has an additional component that more securely engages the clip connector into the channels of the vertical power strip 10 at desired points, while permitting movement of the clip connector by disengaging this component.

Figure 7A:
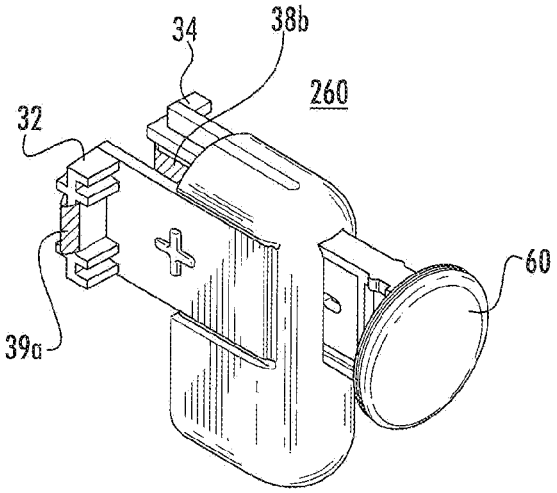
FIG. 7A is a left rear perspective view of a clip connector in accordance with a second embodiment of the present invention.
Figure 7B:
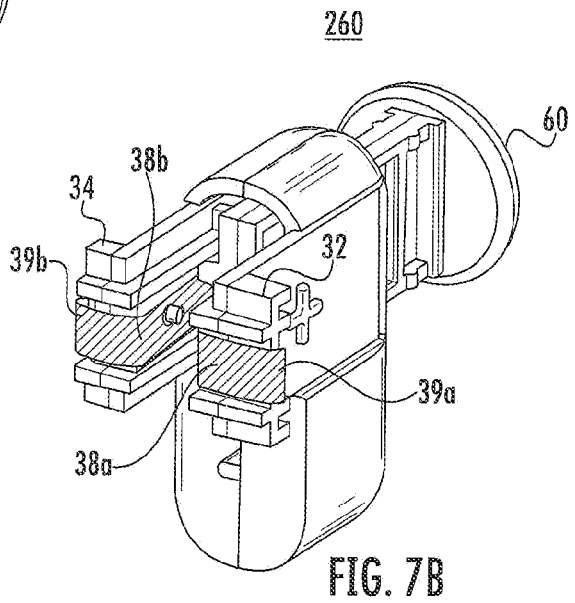
FIG. 7B is a left front perspective view of the clip connector shown in FIG. 7A.
Figure 7C:
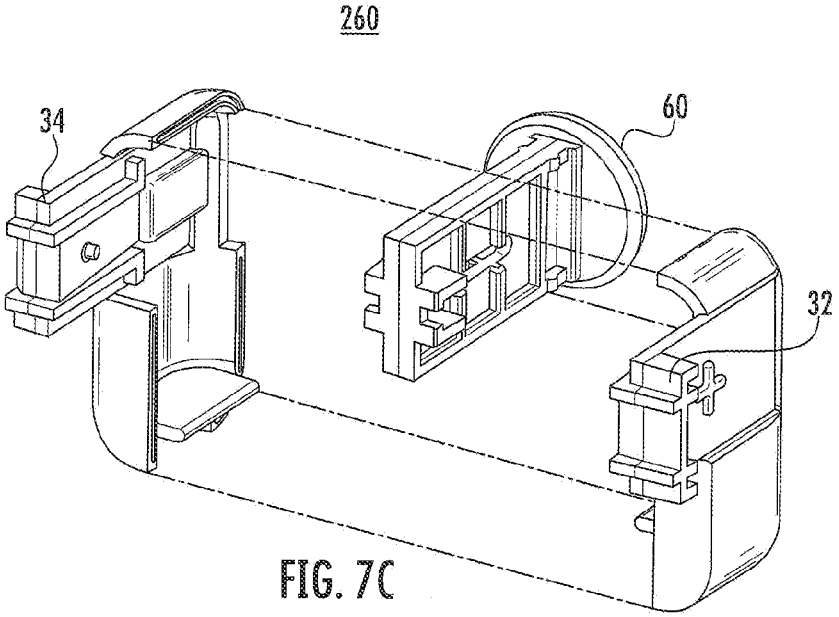
FIG. 7C is an exploded view of the clip connector shown in FIG. 7A.

Specifically, as can be seen in FIGS. 7A to 7C, in the clip connector 260 of the second embodiment, an anchor feature such as a plunger 60 is provided that is disposed into the back of the housing. Just as was the case in the first embodiment, in the second embodiment, the legs may be pinched together to insert the legs 32 and 34 into the channels of the vertical power strip 10. However, whereas in the first embodiment the electrical connection between the leads 38*a* and 38*b* of the spring clip connector 26 and each conductor strip 24 was maintained by the biasing force of the legs 32 and 34, in the second embodiment, a secure connection is provided by the plunger 60 being pushed into the housing, after the clip connector 260 is engaged with the vertical power strip 10, to forcibly urge the legs 32 and 34 apart, causing the legs to securely lodge in the channels and improve contact with the conductive strips 24.

Once the desired position is set, the plunger 60 can be pushed to lock the clip connector 260 into place. This will also improve the clip connector 260 contact with the conductor strips 24 of the vertical power strip 10. To adjust position again, the plunger 60 simply has to be pulled out so that the legs will release in the channel or so that the legs can be compressed together by a user. In this retracted condition, the clip connector 260 can be slid up or down. Thus, the clip connector 260 advantageously provides that once inserted into the conductor channels of the vertical power strip 10, the plunger 60 can be pushed in to lock the clip connector 260 in place. To be moved, the plunger 60 must pulled out, allowing the clip connector 260 to be slid vertically in the vertical power strip 10 to where it needs to be.

The clip connector 260 also employs conductive leads 38*a* and 38*b* and the wire 40 in the same location as in the first embodiment, although the leads and wire are not shown in FIG. 7C for clarity. Other than the operation of the plunger 60 described above, the clip conductor 260 functions and cooperates the same way with the other components as discussed above with reference to the clip conductor 26.

Although example embodiments have been shown and described in this specification and figures, it would be appreciated by those skilled in the art that changes may be made to the illustrated and/or described example embodiments without departing from their principles and spirit.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A power supply system for supplying electrical power to an LED light display module for lighting at least a portion of a fixture, the system comprising:

a power strip connectable to a power supply and configured to be affixable with respect to the fixture, the power strip having:

first and second ridges configured to form, respectively, a first channel along a length of the power strip and a second channel, narrower than the first channel, along the length of the power strip, first and second conductor strips arranged, respectively, in the first and second channels, and a connector at one end of the power strip, configured to electrically couple the first and second conductor strips to the power supply; and a clip connector for supplying power to the LED light display module, the clip connector being configured to detachably connect to the power strip, the clip connector having:

a housing, first and second legs extending from the housing, the first leg being wider than the second leg, the first and second legs being configured with respect to the housing so as to be (a) deflectable in relation to the housing and one another by application of an outside force, and (b) biased to resiliently maintain a spacing between the first and second legs without external application of force, and first and second conductive leads arranged on the first and second legs to form first and second conductive contacts on the first and second legs, the first and second conductive contacts being configured to contact, respectively, the first and second conductor strips of the power strip, after insertion of the first and second legs into the first and second channels, wherein the clip connector and the power strip are configured to cooperate such that the clip connector is insertable into the power strip by a user compressing the first and second legs towards one another and first inserting the first leg into the first channel of the power strip and then inserting the second leg into the second channel of the power strip.

2. The power supply system of claim 1, wherein once the clip connector is inserted into the power strip, the clip connector is movable in a lengthwise direction of the power strip while the first and second legs remain within their respective channels by compressing the first and second legs towards one another.

3. The power supply system of claim 1, wherein the housing and the first and second legs of the clip connector are made of an extruded plastic.

4. The power supply system of claim 1, wherein the first and second conductor strips are arranged in the power strip so as not to be visible to an outside observer.

5. The power supply system of claim 1, wherein the housing of the clip connector comprises indicia to indicate a correct orientation for engaging the clip connector in the channels of the power strip.

6. The power supply system of claim 1, wherein the first and second conductor strips and the first and second conductive leads are made of copper.

7. The power supply system of claim 1, wherein the first and second conductor strips and the first and second conductive leads are made of aluminum.

8. The power supply system of claim 1, wherein the fixture comprises a shelving system including shelves and a backing board, and the power strip is configured to mount to the backing board.

9. The power supply system of claim 8, wherein the power strip is configured to mount to the backing board by pegboard pushpins.

10. The power supply system of claim 8, wherein the LED light display module is arranged below a shelf.

11. The power supply system of claim 1, wherein the first and second conductor strips terminate at one end of the power strip with a barrel connector that electrically couples to the power supply.

12. The power supply system of claim 11, wherein the barrel connector attaches to the conductor strips using ring terminals.

13. The power supply system of claim 1, wherein the clip connector further comprises a plunger movable in the housing between a first, retracted position and a second, engaged position, said plunger configured to, in the engaged position, deflect the first and second legs apart from one another.

14. The power supply system of claim 13, wherein deflection of the first and second legs effected by the plunger in the engaged position: (a) provides a secure electrical connection between first and second conductive contacts and the first and second conductor strips of the power strip, and (b) inhibits movement of the clip connector along the length of the power strip.

15. A clip connector electrically coupled to the LED light display module, the clip connector for detachably connecting to a power strip having first and second channels and first and second conductor strips electrically coupled to a power supply, the clip connector comprising:

a housing;

first and second legs extending from the housing, the first leg being wider than the second leg, the first and second legs being configured with respect to the housing so as to be (a) deflectable in relation to the housing and one another by application of an outside force, and (b) biased to resiliently maintain a spacing between the first and second legs without external application of force; and first and second conductive leads arranged on the first and second legs to form first and second conductive contacts on the first and second legs, the first and second conductive contacts being configured to contact, respectively, the first and second conductor strips of the power strip, after insertion of the first and second legs into the first and second channels, wherein the clip connector is configured to cooperate with the power strip such that the clip connector is insertable into the power strip by a user compressing the first and second legs towards one another and first inserting the first leg into the first channel of the power strip and then inserting the second leg into the second channel of the power strip.

16. The clip connector of claim 15, wherein once the clip connector is inserted into the power strip, the clip connector is movable in a lengthwise direction of the power strip while the first and second legs remain within their respective channels by compressing the first and second legs towards one another.

17. The clip connector of claim 15, wherein the housing and the first and second legs of the clip connector are made of an extruded plastic.

18. The clip connector of claim 15, wherein the housing and the first and second legs of the clip connector are made of an extruded plastic.

19. The clip connector of claim 15, wherein the clip connector further comprises a plunger movable in the housing between a first, retracted position and a second, engaged position, said plunger configured to, in the engaged position, deflect the first and second legs apart from one another.

20. The clip connector of claim 19, wherein deflection of the first and second legs effected by the plunger in the engaged position: (a) provides a secure electrical connection between first and second conductive contacts and the first and second conductor strips of the power strip, and (b) inhibits movement of the clip connector along the length of the power strip.

* * * * *